United States Patent [19]

Grenier

[11] Patent Number: 4,572,401

[45] Date of Patent: Feb. 25, 1986

[54] DEVICE FOR SAFELY HOLDING IN POSITION A RAISED OR LOWERED FLAP

[75] Inventor: Jean Grenier, Pantin, France

[73] Assignee: Louis Vuitton, S.A., Paris, France

[21] Appl. No.: 531,908

[22] Filed: Sep. 12, 1983

[30] Foreign Application Priority Data

Sep. 14, 1982 [FR] France ..... 82 15482

[51] Int. Cl.[4] ..... H05B 3/02; E05C 17/20

[52] U.S. Cl. ..... 220/335; 217/60 C; 292/272; 292/275; 292/338

[58] Field of Search ..... 292/338, 272, 275, 268; 217/60 B, 60 C, 60 D, 61; 220/335

[56] References Cited

U.S. PATENT DOCUMENTS

| | | | |
|---|---|---|---|
| 851,192 | 4/1907 | Younglove | 292/272 |
| 902,730 | 11/1908 | Hill | 292/275 |
| 1,334,546 | 3/1920 | Maros | 217/60 C |
| 1,713,561 | 5/1929 | Sibley | 292/275 X |
| 2,108,891 | 2/1938 | Johnson | 292/275 |
| 2,193,112 | 3/1940 | Peterson | 292/272 X |
| 4,435,007 | 3/1984 | Bascov | 292/272 X |

FOREIGN PATENT DOCUMENTS

| | | | |
|---|---|---|---|
| ST5966 | 5/1956 | Fed. Rep. of Germany | 292/272 |
| 1912949 | 10/1970 | Fed. Rep. of Germany . | |
| WO80/00987 | 5/1980 | PCT Int'l Appl. . | |
| 348370 | 5/1931 | United Kingdom . | |

*Primary Examiner*—Robert L. Wolfe
*Assistant Examiner*—Russell W. Illich
*Attorney, Agent, or Firm*—Merchant, Gould, Smith, Edell, Welter & Schmidt

[57] ABSTRACT

The holding device comprises a part provided at each of its ends with a lug, each lug being caught between the walls of a groove of elongated shape formed in a casing and capable of having a translational and rotational motion, each groove having adjacent at least one of its ends a zone of narrowed cross-section with elastic walls, and each casing being intended for securement to the corresponding element of the jointed assembly to which the device of the invention is applied.

5 Claims, 3 Drawing Figures

DEVICE FOR SAFELY HOLDING IN POSITION A RAISED OR LOWERED FLAP

This invention relates to an improved device for safely holding in position a flap means when the latter is either lifted or lowered.

There are known a great number of devices for meeting this requirement. They are generally realized by means of assembled parts hingedly joined to one another in the manner of the legs of a pair of scissors, compasses or articulated parallelograms and include notching, snapping in, locking systems and the like, for holding such parts together in the desired position when the assembly is open out or folded up.

This type of devices is widely used in case of writing table flaps or other pieces of furniture with socalled folding tables, feet for tables called bridge or camping tables, covers or flaps for suitcases, bags, cases and the like. Although such systems are satisfactory in most utilizations there is a disadvantage not to be neglected in case of suitcases, bags or cases. As a matter of fact, in these latter cases, the legs of the hingedly joined systems generally fold back within the volume realized by such suitcases, bags or cases, and there is a risk of squeezing, jamming, and also cutting or tearing off of those objects which might be caught within such systems. Furthermore, in all the utilizations mentioned above they are sometimes cumbersome or obstructive. Moreover, the holding thereof in the desired position is obtained only after having previously checked that the notching, snapping in or locking means have been suitably engaged, actuated or contacted; otherwise a result completely opposite to the desired one is obtained. For example, it is very disagreeable to see the cover or the flap of a suitcase move down suddenly due to any unintentional engagement with the system for maintaining said cover in the open position.

This invention however obviates these disadvantages and its object is a device providing for the double function of first holding a flap in position when it is being raised or lowered and of ensuring safe conditions for the event that the position holding function should be unintentionally opposed.

The device according to the invention is substantially characterized in that is comprises a part provided at each of its two ends with a respective lug, with each lug being taken between the walls of a groove of elongated shape formed in a casing so as to be translatable or rotatable therein, each groove having adjacent to at least one end a zone of smaller cross-section having walls of a determined elasticity, each casing being securable to the corresponding element of the hingedly joined assembly to which said device is applied.

Other characteristics and advantages of the invention will more clearly appear in the following description which is made with reference to the attached drawings. For illustrating the invention a case or a chest has been taken as the example of application thereof. Thus, in the drawings.

Figure 1:
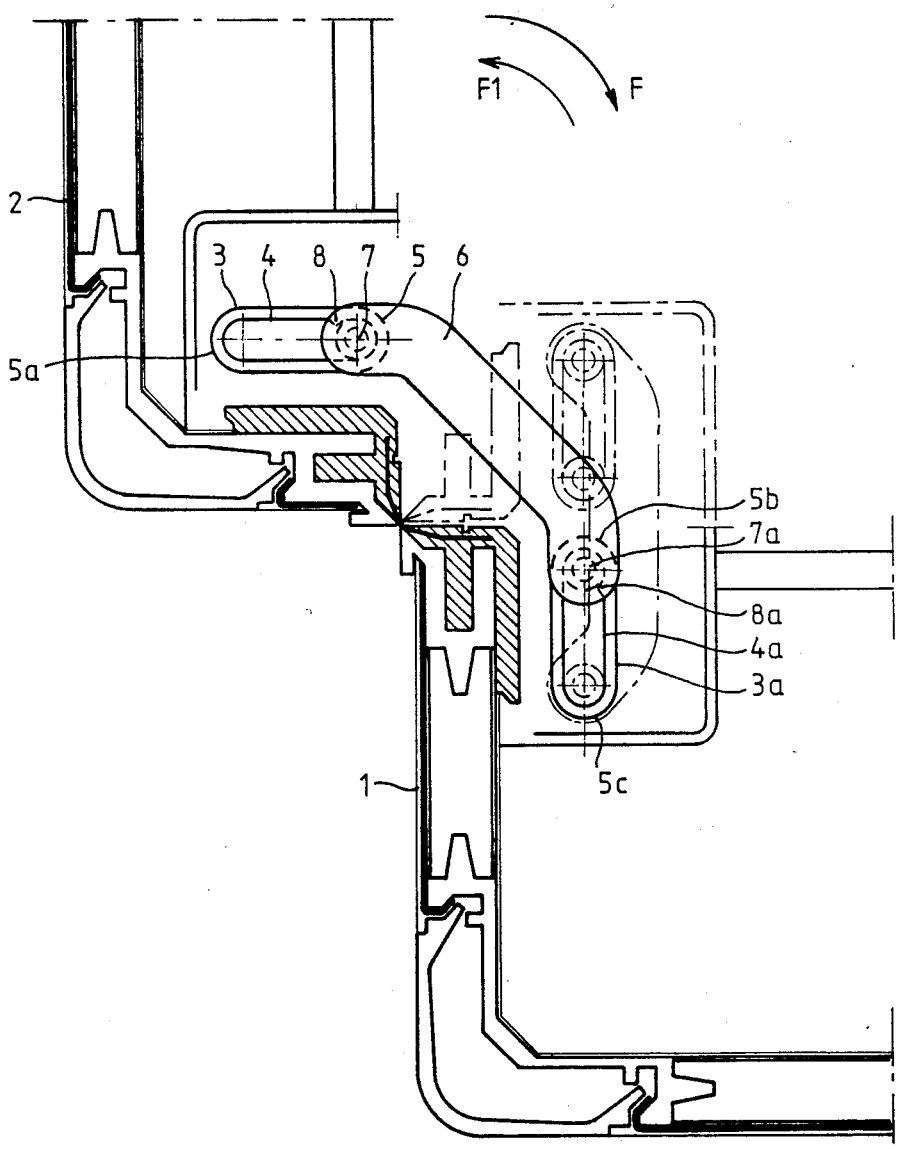
FIG. 1 is a sectional elevational view of a case or chest (in the open position) provided with a device according to the invention.

With reference to the figures, reference numeral 1 designates the container of the chest or the case and reference numeral 2 the corresponding cover thereof. On the inner face of each of both of such parts contained in one and the same vertical plane, there is secured a box 3-3*a* within which there is formed an oblong groove 4-4*a* the ends 5-5*a*, 5*b*-5*c* of which are preferably of a rounded shape. Adjacent to the ends 5 and 5*b* of each of said grooves the cross-section is narrowed and the walls at that point are advantageously of a determined elasticity for reasons which will appear hereinafter. Said walls may for example consists of two bosses or spring blades 8-8*a*.

These two boxes are connected to one another through a flat part 6, for example, bent twice as illustrated in the drawings. This part is provided with a lug 7-7*a* in the neighbourhood of each of the ends thereof.

The operation of the device described above is the following:

The chest or case being in the open position as shown in FIG. 1, it has to be noted first that the lugs 7 and 7*a* cannot cross the narrow portion delimited by the projecting walls 8-8*a* unless a substantial force for causing them to cross such zone is exerted thereon. This is a first safety measure: the cover can only come down under the action of an intentionally applied force of a determined amplitude.

Let us therefore exert such force in the direction of arrow F to urge cover 2 towards the container 1:

In a first step the lug 7 crosses the zone of bosses 8 and effects a translational motion along the groove 4 thereof, with the opposite lug 7*a* serving as the rotational axis of part 6 during the translational motion. At the end of the motion the lug 7 comes into abutment at the bottom of groove 5*a*. If at this moment force F is no longer exerted thereon, the cover can be immobilized in the position reached, since its weight is not sufficient to urge by the bottom of groove 5*a* the part 6 so as to make the lug 7*a* cross the narrowed zone delimited by bosses 8*a* of part 3*a*. This a second safety measure.

On the other hand, if force F is continuously exerted thereon, the lug 5*a* crosses the zone of bosses 8*a* and the cover continues to fold down, said lug 7*a* realizing a translational motion along the groove 4*a* and the lug 7 being used as the rotational axis of part 6 to contribute to this motion. At the end of the stroke (abutment 5*c*) the cover is considered as closed. The respective position of the elements and parts is illustrated by dot and dash lines in FIG. 1.

For opening the flap an opposite force F1 is exerted thereon; the lug 7 originally in abutment against the bottom of groove 5*a* follows the walls of groove 4, then crosses the narrowed zone delimited by bosses 8. If the opening force stops, the position taken by the cover is held by itself, since the weight of the cover is not sufficient to make it fall again, i.e. make the lug 7 cross the zone delimited by boss 8. This is a first safety measure for the open position.

If however the force F1 is continued the link 6 is urged in its turn since lug 7 is in abutment at the bottom of groove 5; the lug 7*a* originally in abutment at the bottom of groove 5*c* follows in groove 5*a*, crosses the zone delimited by boss 8*a* and the position illustrated in FIG. 1 with the double safety measure provided thereby is met again; the respective lugs 7-7*a* are twice in abutment (bottom of groove 5-5*b* and boss 8-8*a*).

Figure 3:
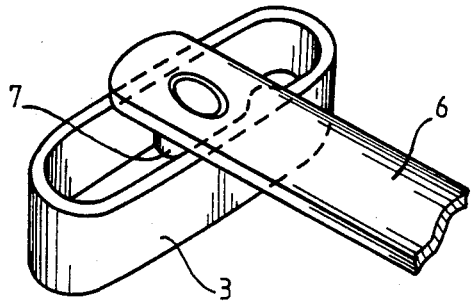
FIG. 3 is a perspective view of a portion of a device according to the invention in one of the possible positions during operation thereof.
Figure 2:
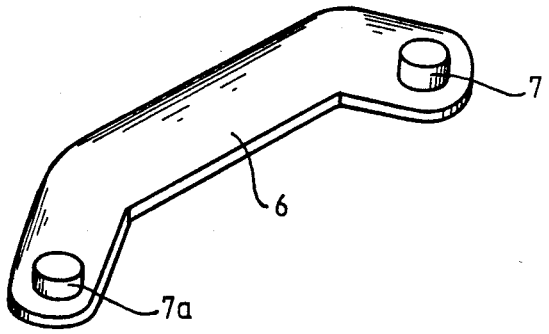
FIG. 2 is a perspective view of a constituent element of the device according to the invention.

FIG. 3 shows how link 6 can rotate by using each lug such as 7 as its rotational axis.

The above description permits to note the main advantages of this invention, and especially minimum obstruction, absence of hinged legs that might become scissors, double safety for the open position a nd the closed position; such safety is the greater the larger the force required for crossing bosses 8-8*a*, as will be easily understood by the man of the art who will then accordingly select constituent materials thereof.

Finally, it will be understood that this invention was only described and represented in a purely explanatory and not at all limitative manner and that any useful modification thereof can be made without departing from its scope as defined in the appended claim.

I claim:

1. An improved device with a double function of holding a flap in position and of providing safety when said flap is raised and lowered, comprising:

a two-portion box, each portion being designed so as to be securable to a corresponding element of a hingedly-joined assembly, each of said portions containing therein an oblong groove having walls of a determined elasticity, each of said oblong grooves including a zone of a smaller cross-section proximate one end thereof; and, a part provided at each of its two ends with a lug, each lug being caught between said walls of one of said grooves, said lugs being capable of translatable and rotational movement within said grooves.

2. An improved device in accordance with claim 1 wherein each of said grooves includes an inwardly-directed boss along said walls.

3. An improved device in accordance with claim 1 wherein each of said grooves includes an inwardly-directed spring blade along said walls.

4. An improved device in accordance with claim 1 wherein said elements are said flap and a container member.

5. An improved device with a double function of holding a flap in position and of providing safety when said flap is raised or lowered, comprising:

a two-portion box, each portion being secured to a corresponding element of a hingedly-joined assembly, said elements being said flap and a container member, each of said portions having formed therein an oblong groove having walls of a determined elasticity, each of said oblong grooves including an inwardly directing boss along said walls and a zone of a smaller cross-section proximate one end thereof; and, a part provided at each of its two ends with a lug, each lug being caught between said walls of one of said grooves, said lugs being capable of translatable and rotational movement within said grooves.

* * * * *